US006132004A

United States Patent [19]

Carlino

[11] Patent Number: 6,132,004

[45] Date of Patent: Oct. 17, 2000

[54] BACK SUPPORT PILLOW SYSTEM

[76] Inventor: Lawrence Carlino, 1441 SW. 21st La., Boca Raton, Fla. 33486

[21] Appl. No.: 09/191,709

[22] Filed: Nov. 13, 1998

[51] Int. Cl.[7] ..... A47C 3/025

[52] U.S. Cl. ..... 297/452.48; 297/284.1

[58] Field of Search ..... 297/284.5, 284.1, 297/284.7, 452.33, 452.48; 5/632, 630

[56] References Cited

U.S. PATENT DOCUMENTS

| | | | |
|---|---|---|---|
| 2,591,306 | 4/1952 | Sherman | 155/173 |
| 2,831,533 | 4/1958 | Pasquarelli | 155/182 |
| 3,197,255 | 7/1965 | Caudill | 297/460 |
| 3,279,849 | 10/1966 | Radke et al. | 297/284 |
| 4,350,338 | 9/1982 | Weiner | 297/284.5 X |
| 4,819,278 | 4/1989 | Ramos | 297/284.5 X |
| 4,824,169 | 4/1989 | Jarrell | 297/230 |
| 4,864,668 | 9/1989 | Crisp | 5/432 |
| 4,883,320 | 11/1989 | Izumida et al. | 297/452 |
| 5,272,780 | 12/1993 | Clute | 5/632 X |
| 5,367,730 | 11/1994 | Sher | 5/632 X |
| 5,433,505 | 7/1995 | Coyne et al. | 297/284.1 |
| 5,533,787 | 7/1996 | Xiang | 297/284.5 |
| 5,630,240 | 5/1997 | Matsuoka et al. | 5/653 |

FOREIGN PATENT DOCUMENTS

| | | | |
|---|---|---|---|
| 000477584 | 6/1929 | Denmark | 5/632 |

OTHER PUBLICATIONS

Easy Ride, Inc., Easy Ride Owner's Manual, cover page, 1984.

*Primary Examiner*—Peter M. Cuomo
*Assistant Examiner*—Stephen Vu
*Attorney, Agent, or Firm*—Oltman, Flynn & Kubler

[57] ABSTRACT

A system having three separate pillows with a primary spinal pillow that sits vertically against the back portion of a chair. This spinal pillow has a characteristic curve that extends laterally across the pillow such that the apex of the curve runs vertically through the center of the pillow. Two other pillows, the thoracic and lumbar pillows fit between the spinal pillow and the back portion of the chair at an adjustable height to suit the user. These pillows enhance overall posture control during sitting by encouraging users to center themselves on the spinal pillow. Enhanced control of the muscles, joints and ligaments provides a more comfortable and correct sitting posture that decreases spinal stresses that can cause pain and discomfort. Alternatively the spinal pillow may be used by itself.

5 Claims, 3 Drawing Sheets

BACK SUPPORT PILLOW SYSTEM

This invention relates generally to therapeutic devices and in particular to a back support device comprised of one or more shaped pillows.

BACKGROUND OF THE INVENTION

Many people suffer from varying degrees of back pain and discomfort. This becomes especially true when an individual is required to sit for extended periods. Different chairs and cushions or pillows for chairs have been developed to provide their users with comfort and proper support for sitting. It is generally believed that improper sitting posture contributes to back discomfort, fatigue, and other health problems.

It is well known to provide pillows or cushions to make chairs more comfortable. The Sherman U.S. Pat. No. 2,591,306 discloses a wedge shaped pillow with a weighted handle constructed to be hung over the back of a chair at varying heights. The Pasquarelli Pat. No. 2,831,533 and Radke U.S. Pat. No. 3,279,849, also disclose small, vertically adjustable pillows intended for back support. In Coyne U.S. Pat. No. 4,471,993, another type of seat cushion is disclosed. This reference shows a cushion with an adjustable inner support pad that can be moved to different arrangements as desired by the user. In the Crisp U.S. Pat. No. 4,864,668, a portable back support is disclosed. This support is narrow and extends from the seat of the chair up to approximately between the user's shoulder blades.

While the aforementioned cushions and pillows are not without merit, none of them include the variety of features of the present invention as herein described. There exists a need for an inexpensive pillow system that is easily adjustable and provides the user with a comfortable sitting arrangement while encouraging proper posture.

SUMMARY OF THE PRESENT INVENTION

The present invention includes a new and useful pillow system for chairs, which provides the user with support and comfort. The invention consists of up to three separate pillow elements that may be used in combination with one another. The primary pillow element is a spinal pillow having a characteristic curve on the side against which the user rests his or her back. A second pillow element included in the invention is the thoracic wedge. A third pillow element included in the invention is the lumbar wedge.

A primary object of this invention is to provide a back support device for chairs.

Another object of this invention is to provide a back support device that encourages users to center themselves on the pillow.

Another object of this invention is to provide a back support device that encourages a natural, comfortable, and proper sitting posture.

Yet another object of this invention is to provide a back support device that is fully adjustable to accommodate users of different body sizes and preferences.

Further objects of the present invention will become apparent from the following detailed description and accompanying drawings that form a part of the specification.

DESCRIPTION OF THE PREFERRED EMBODIMENTS

Before explaining the disclosed embodiments of the present invention in detail it is to be understood that the invention is not limited in its application to the details of any particular arrangement shown since the invention is capable of other embodiments. Also, the terminology used herein is for the purpose of description and not of limitation.

Figure 2:
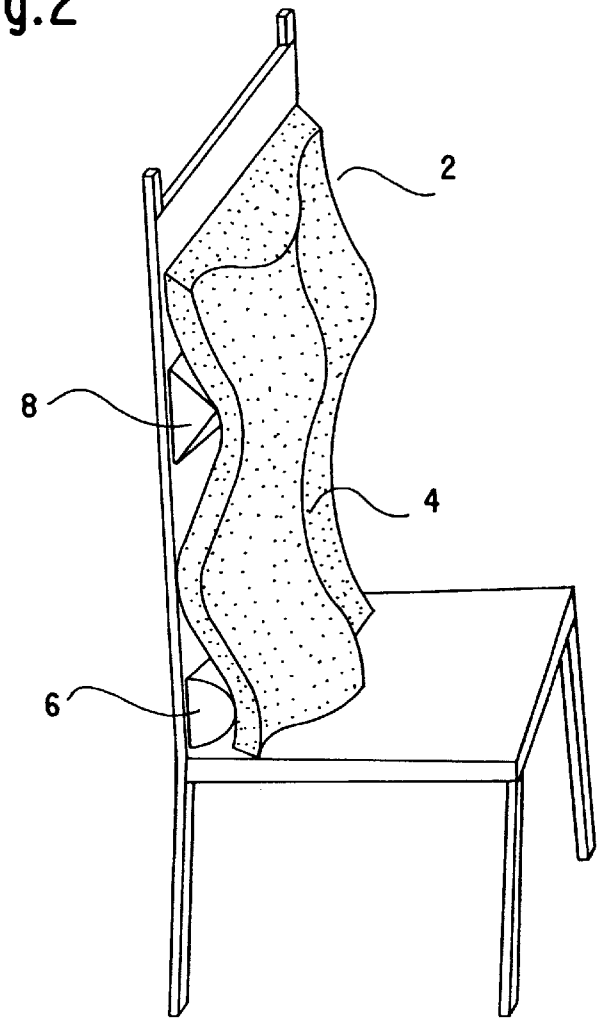
FIG. 2 is a perspective view of a chair with the back support pillow system installed.
Figure 1:
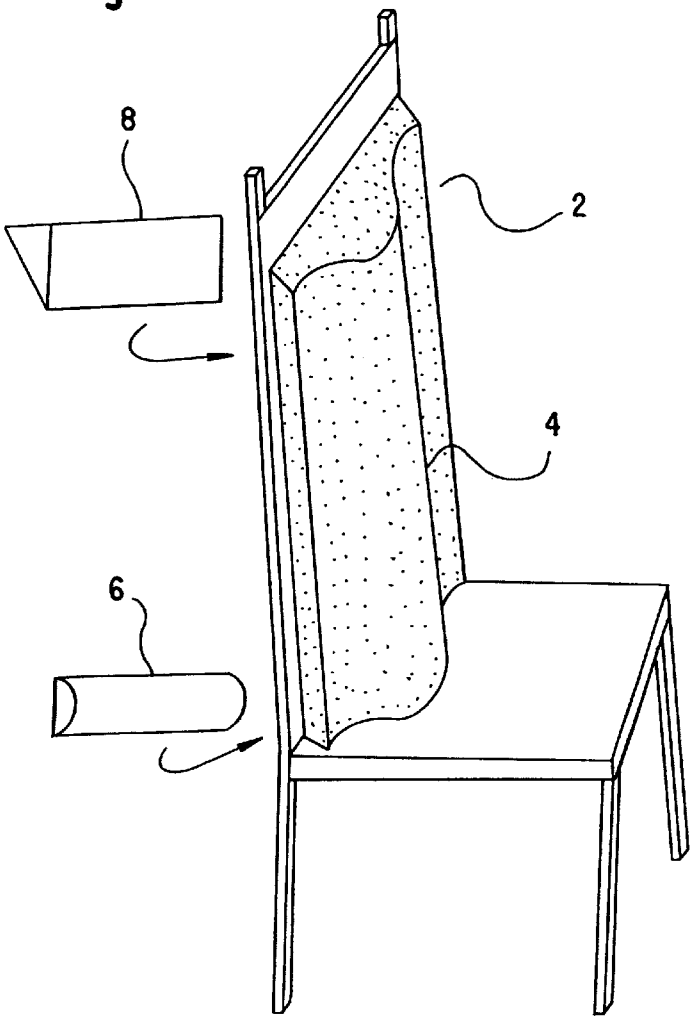
FIG. 1 is a perspective view of a chair indicating the relative positions of the pillows.

FIGS. 1 and 2 show a perspective view of the invention indicating the relative positions of the pillows on a chair. It should be noted that the invention is not limited to the particular chair shown. It would be apparent to one skilled in the art that the invention could be used on a variety of chairs. The spinal pillow 2 rests against the back of the chair, with the contour surface 4 facing towards the user's back. The lumbar wedge pillow 6 may be placed near the seat of the chair, between the spinal pillow 2 and the seat of the chair. This pillow may be moved up or down to suit the user. The thoracic wedge pillow 8 fits between the spinal pillow 2 and the back of the chair at a height near the user's shoulders. The height of this pillow may also be adjusted up or down to suit the user.

Figure 3:
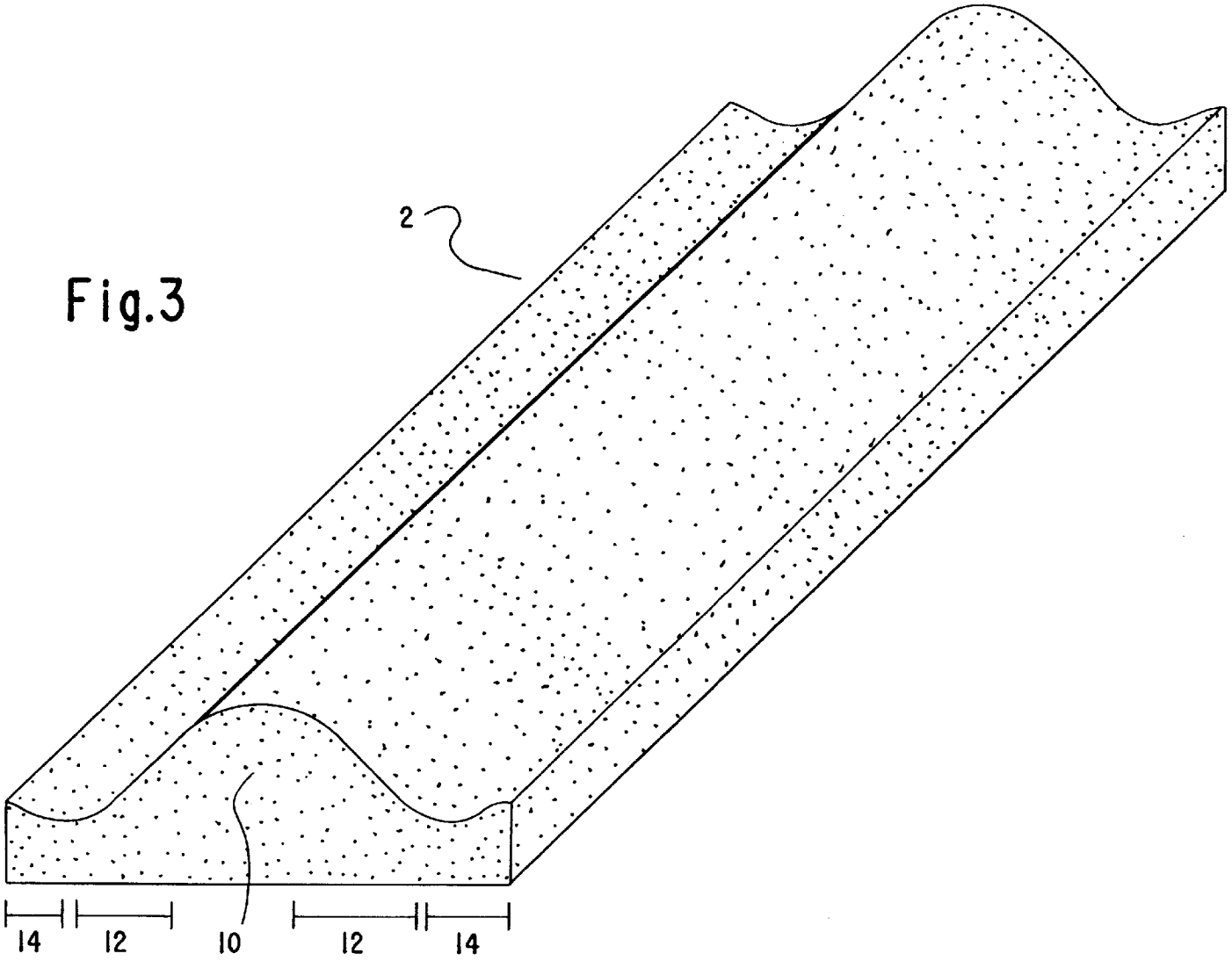
FIG. 3 shows a lateral view of the spinal pillow.

FIG. 3 shows a lateral view of the spinal pillow. The spinal pillow 2 is specially shaped to include a predetermined curve 10 that rests against the center of the user's back when he or she is seated. The curve extends laterally across the pillow and is such that the thickest part of the pillow is a rise extending vertically along the middle of the pillow. The curve tapers 12 from this middle section toward the two sides. Near each side however the pillow again flares out and thickens slightly 14. The five other sides of the spinal pillow are generally flat surfaces, though not all are visible from the perspective shown.

The unique shape of the spinal pillow encourages users to center themselves on the pillow. Users are encouraged to center themselves on the pillow because the contour of the pillow makes them aware of when they are not centered on the pillow. This enhances overall posture and causes the users to increase control of the muscles, joints, and ligaments of the back while sitting. The result is a comfortable, correct sitting posture that decreases spinal stresses that can cause discomfort and pain.

In one embodiment of the invention, the spinal pillow is 24 inches long, and 12 inches wide. At its thickest point, which runs the length of the pillow, it is 4½ inches and it tapers to 1½ inches at its narrowest points. The pillow thickens near the two lateral sides to 2 inches. This pillow may be used alone or in combination with the other pillows.

Figure 4:
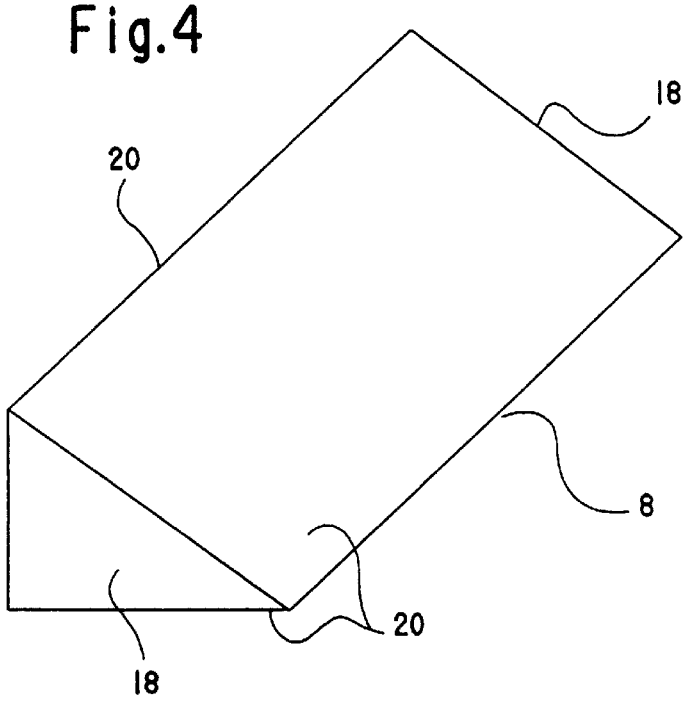
FIG. 4 shows a lateral view of the thoracic wedge pillow.

FIG. 4 shows a lateral view of the thoracic wedge pillow 8. This pillow is wedge-shaped and has two opposing, flat, triangular surfaces 18 connected by three flat rectangular surfaces 20, not all of which are visible from the perspective shown. This pillow is meant for use between the chair and the back of the spinal pillow at an adjustable height somewhere between the top of the user's shoulders and the shoulder blades. In one embodiment of the invention, the thoracic wedge pillow is 12 inches wide, 6 inches tall and 4½ inches deep.

Figure 5:
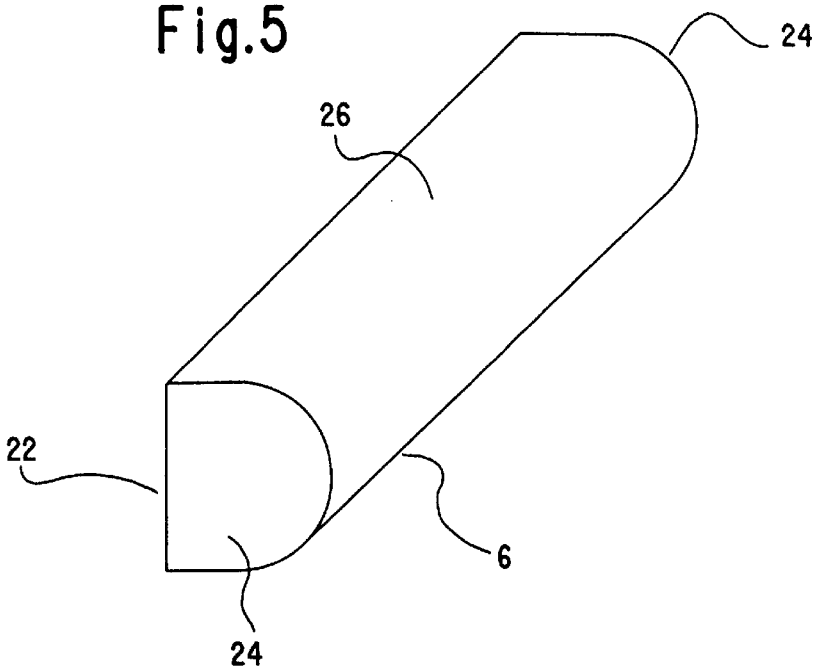
FIG. 5 shows a lateral view of the lumbar wedge pillow.

FIG. 5 shows a lateral view of the lumbar wedge pillow 6. This pillow is shaped like a half-cylinder with one flat rectangular side 22, two flat semicircular sides 24 and a rounded, U-shaped side 26 connecting the other three sides, though not all of these sides are visible from the perspective shown. This pillow is for use between the chair and the back of the spinal pillow at a height between the user's waistline and buttocks. The height of the lumbar wedge pillow is adjustable to suit the user. In one embodiment of the invention, the lumbar wedge pillow is 12 inches wide, 4½ inches tall and 4 inches deep.

These three pillows may be constructed from foam rubber or similar material and have a removable fabric covering fitted to the shape of each pillow. This foam rubber may be selected such that it has certain memory characteristics that enable the pillows to specifically accommodate the body of a user. The foam rubber should also be of a predetermined firmness and resiliency to provide adequate user support. Pillows of varying firmness could be made available to suit a particular user's taste. The pillow device supports the spine in an attempt to decrease the stressful forces about the spinal joints and ligaments.

While the invention has been described, disclosed, illustrated, and shown in various terms and certain embodiments, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A back supporting spinal pillow for a chair having a chair seat and a chair back portion, said pillow comprising:

a flat top surface and two side surfaces;

a bottom surface for resting against a chair seat;

a flat back surface for resting against a chair back portion; and a front surface having an upright middle portion and being contoured such that a curve extends across said front surface, said curve having an apex extending substantially vertically along said middle portion along substantially the entire vertical extent of said front surface to encourage users to center the user spine on said pillow and to increase user support and comfort such that the spinal pillow is thickest at said middle portion and tapers toward either side of the pillow, wherein the pillow begins to thicken again at either side of the pillow.

2. A back support system for a chair having a chair seat portion and a chair back portion, said system comprising:

a vertical spinal pillow extending upwardly from the seat portion of a chair;

said spinal pillow having a middle portion, a flat top, bottom and two side surfaces and having a flat back surface for resting against the back portion of a chair, and also having a front surface contoured such that a curve extends across said front surface, said curve having an apex extending substantially vertically along said middle portion such that the spinal pillow is thickest at said middle portion and tapers toward either side of the pillow, wherein the pillow begins to thicken again at either side of the pillow;

a thoracic wedge pillow constructed for use between the back portion of a chair and the vertical spinal pillow, said thoracic pillow having two flat triangular surfaces and three flat rectangular surfaces attached thereto, wherein said rectangular surfaces are of a similar width as the vertical spinal pillow; and a lumbar wedge pillow constructed for use between the back portion of a chair and the vertical spinal pillow, said lumbar wedge pillow having a flat rectangular back surface, and having two semicircular surfaces attached to opposite sides of the flat rectangular back surface and a curved surface connecting the two semicircular surfaces with the flat rectangular back surface.

3. The back support system of claim 2 wherein said spinal pillow, said lumbar wedge pillow and said thoracic wedge pillow are constructed from foam rubber and covered with a fitted fabric material.

4. The back support system of claim 3 wherein said spinal pillow, said lumbar wedge pillow and said thoracic wedge pillow are constructed from a foam rubber material having certain memory characteristics such that said spinal pillow, said lumbar wedge pillow and said thoracic wedge pillow specifically accommodate the user's body.

5. The back support system of claim 4 wherein the fitted fabric material covering the pillows is removable.

* * * * *